US009136957B1

(12) United States Patent
Napolitano et al.

(10) Patent No.: US 9,136,957 B1
(45) Date of Patent: Sep. 15, 2015

(54) MOBILE DEVICE ACTIVATION FOR EVENTS

(75) Inventors: Michael Napolitano, Reston, VA (US); Sei Y. Ng, Olathe, KS (US); M. Jeffrey Stone, Overland Park, KS (US)

(73) Assignee: Sprint Communications Company L.P., Overland Park, KS (US)

( * ) Notice: Subject to any disclaimer, the term of this patent is extended or adjusted under 35 U.S.C. 154(b) by 1741 days.

(21) Appl. No.: 11/614,744

(22) Filed: Dec. 21, 2006

(51) Int. Cl.
*H04H 20/38* (2008.01)
*H04H 40/27* (2008.01)

(52) U.S. Cl.
CPC ..... *H04H 20/38* (2013.01); *H04H 40/27* (2013.01)

(58) Field of Classification Search
CPC ..... G06F 1/1698; H04H 20/57; H04H 20/38; H04H 20/61; H04H 40/27
USPC ..... 455/3.06, 414.1, 435.1
See application file for complete search history.

(56) References Cited

U.S. PATENT DOCUMENTS 4,097,809 A * 6/1978 Miller ..... 455/11.1
5,513,384 A * 4/1996 Brennan et al. ..... 455/180.1
5,887,253 A * 3/1999 O'Neil et al. ..... 455/418
6,434,398 B1 * 8/2002 Inselberg ..... 455/517
7,124,425 B1 * 10/2006 Anderson et al. ..... 725/68
7,210,160 B2 * 4/2007 Anderson et al. ..... 725/81
7,214,425 B2 * 5/2007 Kolmes et al. ..... 428/357
7,266,383 B2 * 9/2007 Anderson ..... 455/518
7,493,105 B2 * 2/2009 Walden et al. ..... 455/414.1
2002/0063799 A1 * 5/2002 Ortiz et al. ..... 348/559
2002/0115454 A1 * 8/2002 Hardacker ..... 455/457
2004/0087320 A1 * 5/2004 Kim et al. ..... 455/458
2005/0223410 A1 * 10/2005 Li et al. ..... 725/135
2006/0056396 A1 * 3/2006 Chao et al. ..... 370/352
2006/0148467 A1 * 7/2006 Kreitzer et al. ..... 455/426.1
2007/0018952 A1 * 1/2007 Arseneau et al. ..... 345/156
2008/0242224 A1 * 10/2008 Fratti et al. ..... 455/3.06

* cited by examiner

*Primary Examiner* — Christopher M Brandt
*Assistant Examiner* — Edd Rianne Plata

(57) ABSTRACT

A method of activating mobile devices for events is provided. A mobile device owner pays for a subscription to receive local broadcasts of an event on a mobile device. An employee uses a scanner to scan a bar code on the mobile device, or the mobile device owner inputs information identifying the mobile device through a website. A database manager adds an identifier corresponding to the mobile device to an activation list. The broadcaster includes the activation list in the local broadcast stream, thereby activating the subscribed mobile devices for the event.

19 Claims, 4 Drawing Sheets

MOBILE DEVICE ACTIVATION FOR EVENTS

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

A mobile device user can use a mobile device to enhance the experience of attending an event. For example, an automobile racing enthusiast can use a particular mobile device at an automobile race track that enables the enthusiast to select portions of an automobile race to watch from various broadcast cameras and to select different radio conversations to listen between various automobile drivers and their pit crews. Broadcasters of events can rent such mobile devices to mobile device users, but a rental process can require a significant amount of time and money to distribute the mobile devices to the users before the event and to collect the mobile devices after the event. Some enthusiasts who regularly attend such events may prefer to purchase mobile devices for reuse at future events.

The above described situation presents unique problems that are not adequately addressed by existing device activation systems. For example, a large number of broadcast transmission receivers need to be activated and/or deactivated on an event by event basis. Because the event is broadcast only locally to mobile devices, the activation of the mobile device is continued when the mobile device is temporarily moved out of the limited broadcast range to avoid the need for reactivation when the mobile device is returned to within the limited broadcast range. However, continuous activation creates problems for mobile devices reported as lost or stolen, which need to be deactivated before or during an event. Continuous activation also enables a mobile device to receive broadcasts of subsequent events for which the mobile device is not subscribed. The activation from different sources could be accommodated, including internet subscriptions and point-of-sale transactions. Broadcasters and mobile device users each benefit from a device activation system that addresses these and other problems.

SUMMARY

Accordingly, various systems and methods for event-based activation of mobile devices are disclosed herein. In some method embodiments, a mobile device is scanned for activation to receive a local broadcast of an event. An identifier for the mobile device is added to an activation list of identifiers. The activation list is provided to a broadcaster, wherein the broadcaster locally broadcasts the activation list to activate mobile devices for the event.

A system embodiment includes an activation system, a database manager and an interface. The activation system identifies a mobile device for activation to receive a local broadcast of an event. The database manager adds an identifier for the mobile device to an activation list of identifiers. The interface provides the activation list to a broadcaster, wherein the broadcaster locally broadcasts the activation list to activate mobile devices for the event.

In yet another embodiment, a method of activating mobile devices for events is provided. A user input identifying a mobile device for activation to receive a local broadcast of an event is obtained. An identifier for the mobile device is added to an activation list of identifiers. The activation list is provided to a broadcaster, wherein the broadcaster locally broadcasts the activation list to activate mobile devices for the event.

These and other features and advantages will be more clearly understood from the following detailed description taken in conjunction with the accompanying drawings and claims.

BRIEF DESCRIPTION OF THE DRAWINGS

For a more complete understanding of the present disclosure and the advantages thereof, reference is now made to the following brief description, taken in connection with the accompanying drawings and detailed description, wherein like reference numerals represent like parts.

DETAILED DESCRIPTION

It should be understood at the outset that although implementations of various embodiments of the present disclosure are described below, the present system may be implemented using any number of techniques, whether currently known or in existence. The present disclosure should in no way be limited to the implementations, drawings, and techniques described below, but may be modified within the scope of the appended claims along with their full scope of equivalents.

Various methods and systems of mobile device activation are provided. After a mobile device owner pays for a subscription to receive local broadcasts of an event on a mobile device, an employee can use a scanner to scan a bar code on the mobile device, or the mobile device owner can input information identifying the mobile device through a website. Some embodiments activate mobile devices that are rented as well as mobile devices that are sold. A database manager adds an identifier corresponding to the mobile device to an activation list. Some embodiments check a deactivation list before adding the identifier to the activation list to insure that the mobile device has not been reported as lost or stolen. The broadcaster includes the activation list in the local broadcast stream, thereby activating the subscribed mobile devices for the event. Some embodiments broadcast an event code to maintain activation of subscribed mobile devices. In some embodiments, an activation problem is addressed by broadcasting a universal activation code to activate all mobile devices at the event until the problem is corrected, eliminating the possibility of activation problems interrupting the broadcast for subscribed mobile devices. In this manner, the subscribed mobile devices are activated efficiently on an event-by-event basis.

Figure 1:
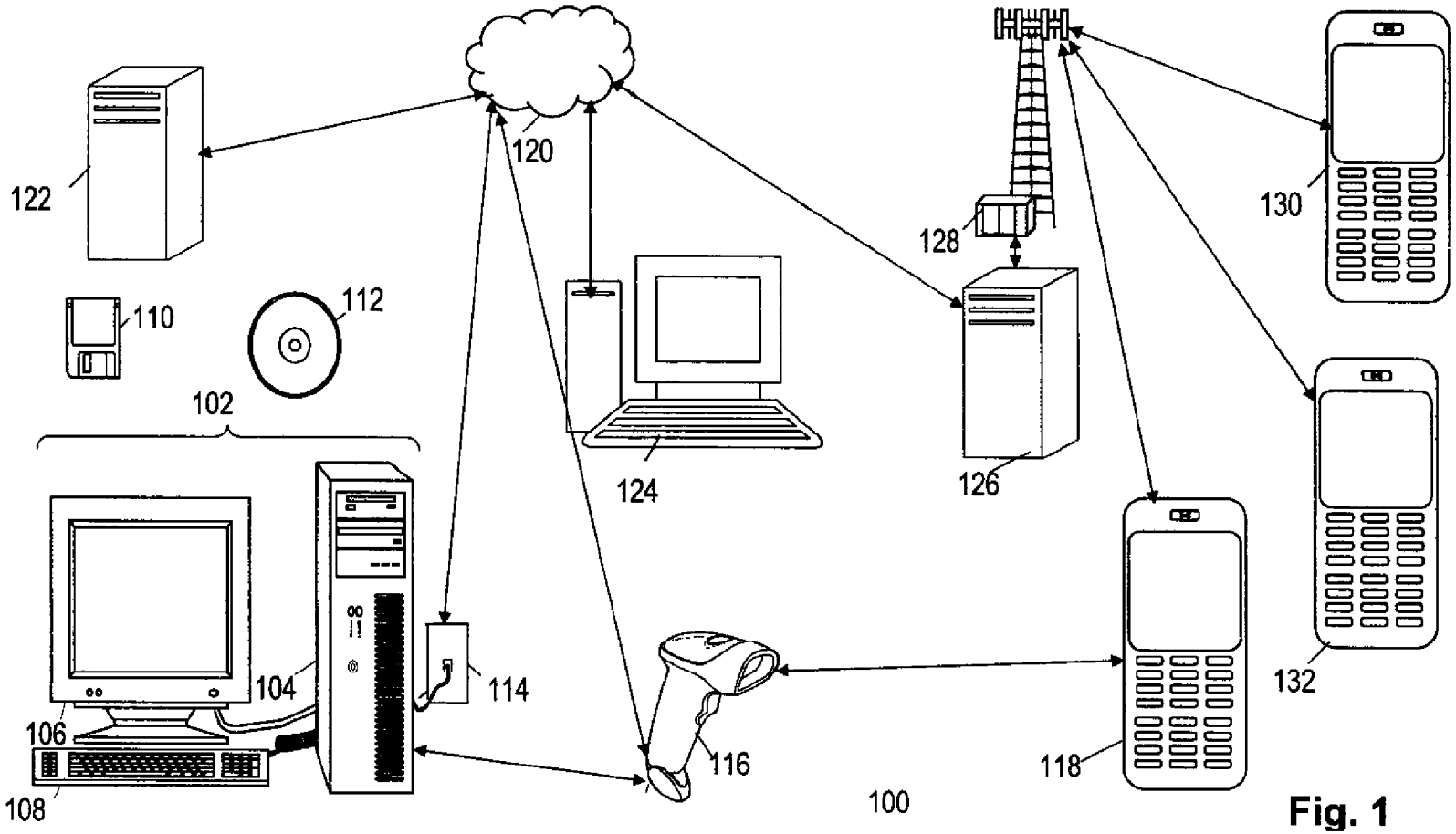
FIG. 1 shows an illustrative mobile device activation system according to some embodiments of the present disclosure.

FIG. 1 shows an illustrative system 100 for implementing mobile device activation methods according to some embodiments of the present disclosure. The system 100 is shown as including a desktop computer 102, although any electronic device having some amount of computing power coupled to a user interface can be configured to carry out aspects of the methods disclosed herein. Among other things, servers, portable computers, personal digital assistants (PDAs) and mobile phones can be configured to carry out aspects of the disclosed mobile device activation methods.

As shown, the desktop computer 102 comprises a chassis 104, a display 106, and input devices 108 and 116. The chassis 104 comprises a processor, memory, and information storage devices. One or more of the information storage devices can store programs and data on removable storage media such as a floppy disk 110 or an optical disc 112. The chassis 104 can further comprise a network interface 114 that allows the desktop computer 102 to receive information via a wired or wireless network, represented in FIG. 1 by a phone jack.

The chassis 104 is coupled to the display 106 and the input device 108 to interact with a user of a mobile device activation system. The display 106 and the input device 108 can together operate as a user interface. The input device 108 is shown as a keyboard, but can take many alternative forms such as a keypad, a camera, a microphone, or other means for receiving information from a user, information such as identifiers of mobile devices for activation to receive a local broadcast of an event.

A scanner 116 can serve as an input device to the desktop computer 102, specifically by identifying a mobile device 118 for activation to receive a local broadcast for an event. For example, the scanner 116 identifies the mobile device 118 by scanning a barcode on the mobile device 118. The owner or user of the mobile device 118 can select aspects of the local broadcast to receive on the mobile device 118.

The desktop computer 102 can communicate through the network interface 114 and a wired or wireless network 120 with a database server 122, which in turn can communicate with various devices, such as a mobile device owner computer 124 and a broadcast server 126. Alternatively, if the scanner 116 has some of the capabilities of the desktop computer 102, the scanner 116 can bypass the desktop computer 102 to communicate with the database server 122 through the wired or wireless network 120. The desktop computer 102 or the scanner 116 can communicate identifiers of mobile devices for activation to the database server 122, which can compile an activation list of mobile devices for activation. The owner of the mobile device 118 can enter input to the mobile device owner computer 124 identifying the mobile device 118 for activation to receive a local broadcast of an event. The mobile device owner computer 124 can communicate the identifier for the mobile device 118 through the wired or wireless network 120 to the database server 122. The broadcast server 124 can retrieve the activation list of mobile devices for activation from the database server 122 through the wired or wireless network 120. Then the broadcast server 124 can be accessed by broadcast communications facilities to retrieve the activation list for inclusion in the broadcast stream through a broadcast network 128 to the mobile devices 118, 130, and 132 by a standard wireless telephony protocol (such as code division multiple access), a wireless Internet connection, WiMAX, or some other means of wireless communication.

Figure 2:
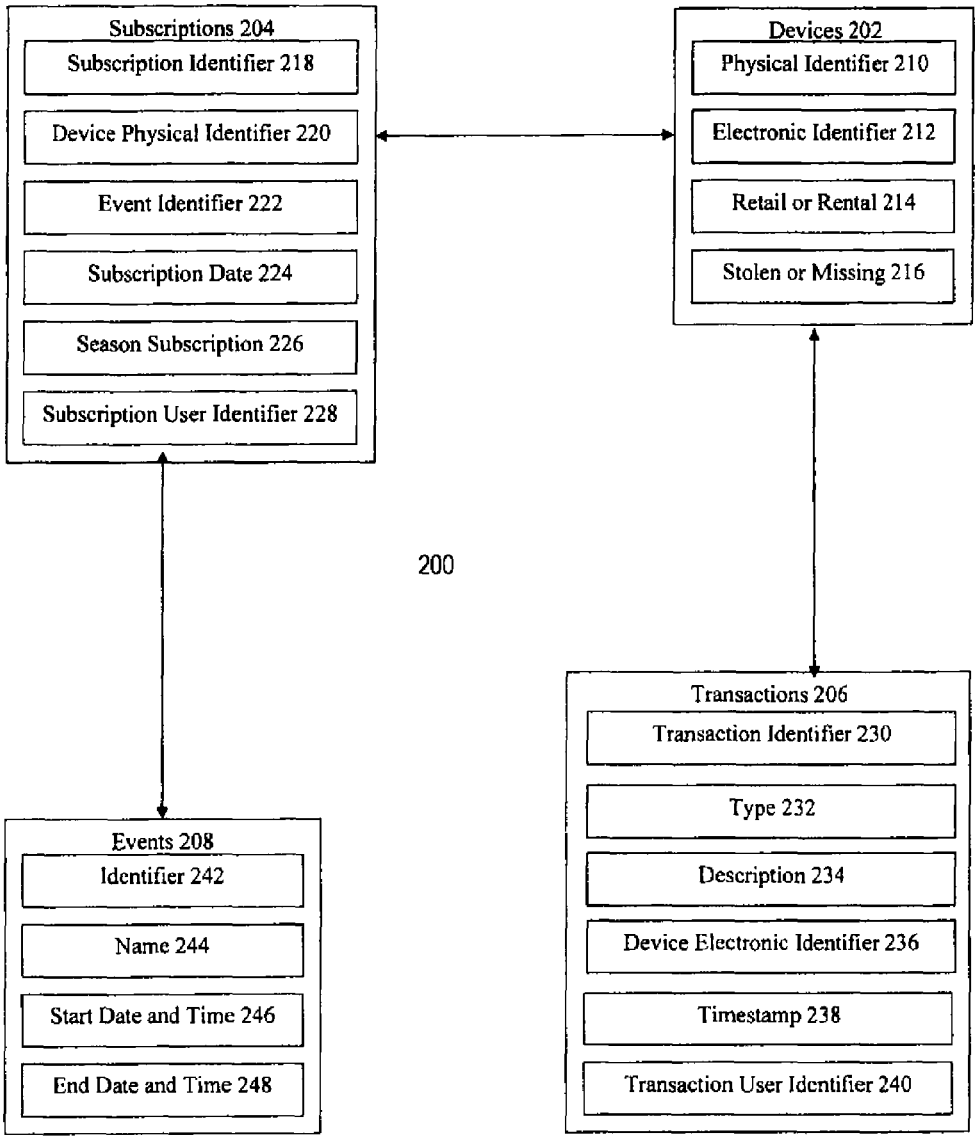
FIG. 2 shows a schema for a mobile device activation database according to some embodiments of the present disclosure.

Turning now to FIG. 2, a schema 200 for a mobile device activation database is depicted according to some embodiments of the present disclosure. A mobile device activation system can use a database manager application to manage such a database of device data, subscriptions data, transactions data, and event data to record subscriptions for mobile devices to receive local broadcasts of events and to activate mobile devices to receive local broadcasts of events. The diagram 200 shows a devices 202 table, a subscriptions 204 table, a transactions 206 table, and an events 208 table. The numbers and types of tables and data are depicted for the purpose of an illustrative example only, as the diagram 200 can include any number or types of tables and data.

The device 202 table can include data for each mobile device 118. The devices 202 table includes physical identifier 210 field, electronic identifier 212 field, rental or retail 214 status, and stolen or missing 216 status. The physical identifier 210 field can be an identifier that uniquely identifies the mobile device 118 physically, such as a bar code externally located on the surface of the mobile device 118. The electronic identifier 212 can be a unique electronic identifier that is internal to the mobile device 118, such as an electronic serial number that is burned into a memory location in the mobile device 118.

The retail or rental 214 status can specify whether the mobile device 118 is a mobile device for a retail owner, such that the mobile device 118 can be purchased or has been purchased, or a mobile device for a rental user, such that the mobile device 118 can be rented on the basis of an event. If the mobile device 118 has been rented previously, the mobile device 118 can be subsequently sold, such as a mobile device 118 refurbished for sale. The stolen or missing 216 status can specify whether a retail owner or rental user reported the mobile device 118 is stolen or missing.

The subscriptions 204 table includes data for subscriptions by mobile device owners to receive local broadcast of events on their mobile devices. The subscriptions 204 table includes subscriber identifier 218 field, device physical identifier 220 field, event identifier 222 field, subscription date 224 field, season subscription 226 field, and subscription user identifier 228 field. The subscription identifier 218 field can be a unique identifier for each recorded subscription by a mobile device owner to receive local broadcasts of events on the mobile device 118. The device physical identifier 220 field can uniquely identify one mobile device by a physical identifier, such as a bar code located on the external surface of the mobile device 118. The device physical identifier 220 can associate each subscriptions 204 table with one devices 202 table for a particular mobile device. The event identifier 222 field can uniquely identify one particular events 208 table for each subscriptions 204 table.

The subscription date 224 field can specify when an owner of the mobile device 118 subscribes to receive a local broadcast of an event on the mobile device 118. The season subscription 226 field can specify whether a subscription is for an entire season of events, rather than a subscription for a single event. Additionally, the season subscription 226 field can specify that a subscription is for a combination of events, such as a consecutive or non-consecutive series of events for a geographic region, rather than a single subscription or a season subscription. The subscription user identifier 228 field can identify the mobile device activation system user who recorded the subscription.

The transactions 206 table includes data for transactions regarding each mobile device 118. The transactions 206 table includes transaction identifier 230 field, type 232 field, description 234 field, device electronic identifier 236 field, timestamp 238 field, and transaction user identifier 240 field. The transaction identifier 230 field can uniquely identify a transaction regarding the mobile device 118, such as by use of a transaction number. The type 230 field can specify the type of transaction, such as a sale of the mobile device 118 or a return of the mobile device 118 for repair. The description 234 field can specify additional information for a transaction beyond the type 232 field, such as the identification of a rental mobile device loaned to a mobile device owner who returned a retail mobile device for repair. The device electronic identifier 236 field can uniquely identify the mobile device 118 for the transactions 206 table, such as by an electronic serial number that is burned into a memory location for the mobile device 118. The timestamp 238 field can specify the time and date for a transaction, while the transaction user identifier 240 field can identify the mobile device activation system user who recorded the transaction.

The events 208 table includes data for events broadcast locally to the mobile device 118. The events 208 table includes identifier 242 field, name 244 field, start date and time 246 field, and end date and time 248 field. The identifier 242 field is a unique identifier for an event, such as an event number, by which one particular subscriptions 204 table can be associated with one particular events 208 table. The names 244 field can specify the name of an event, such as the name of a particular automobile race known by its location. The start date and time 246 field can specify the start date and time for the event, which is when the broadcaster may begin locally broadcasting the event to mobile devices. The end date and time 248 field can specify the end date and time for an event, which is when the broadcaster may stop locally broadcasting the event to mobile devices.

Figure 3:
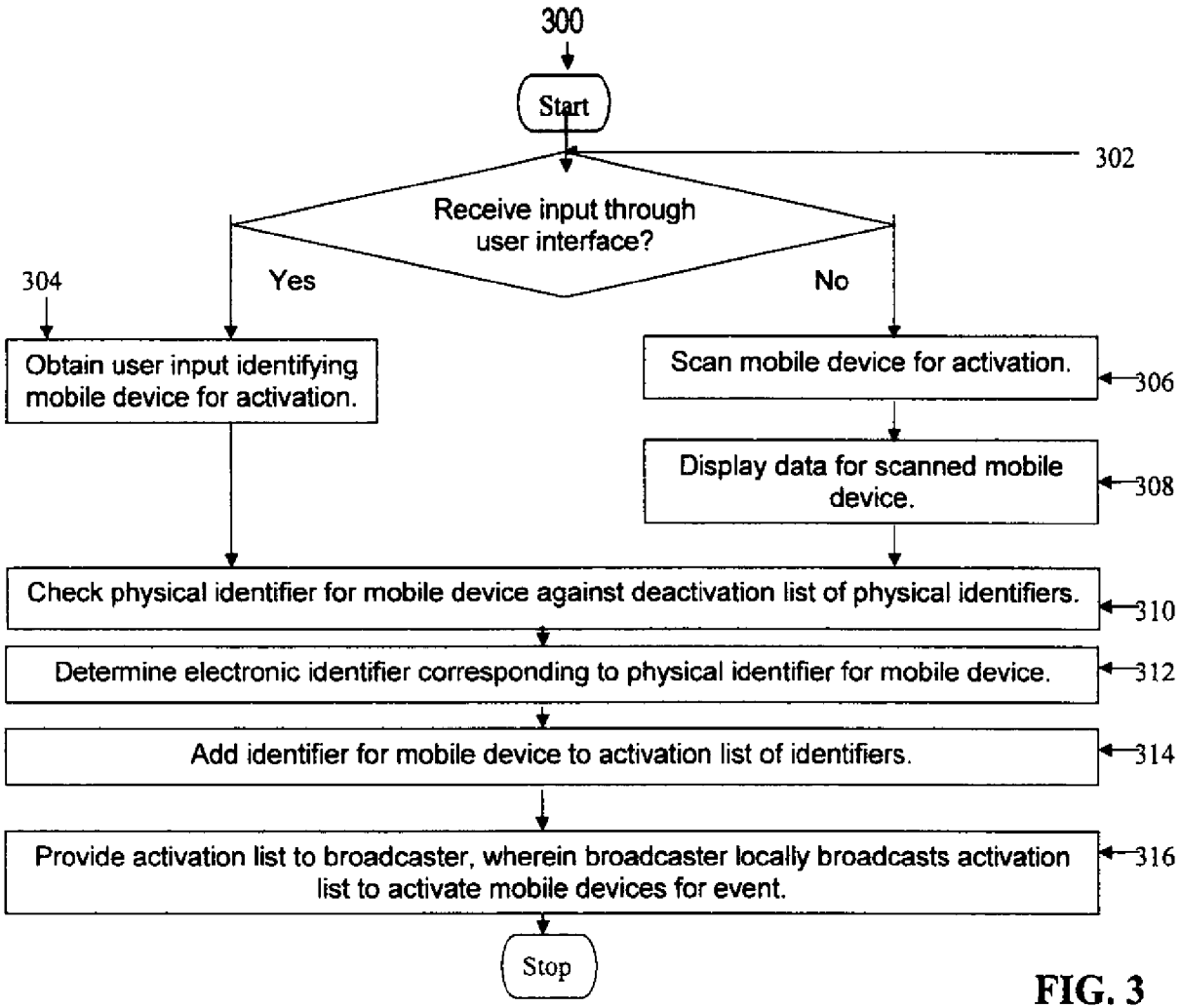
FIG. 3 shows an illustrative mobile device activation method according to some embodiments of the present disclosure.

Turning now to FIG. 3, an illustrative mobile device activation method is depicted according to some embodiments of the present disclosure. The mobile device activation method enables a mobile device activation system to record subscriptions for mobile devices to receive local broadcasts of events and to activate mobile devices to receive local broadcasts of events.

In box 302, a mobile device activation system determines whether to receive input through a user interface. If the mobile device activation system determines to receive input through the user interface, the method continues to box 304. If the mobile device activation system determines not to receive input through the user interface, the method proceeds to box 306.

In box 304, the user interface obtains user input identifying the mobile device 118 for activation. For example, the mobile device owner enters the physical identifier 210 field, such as a bar code identifier, for the mobile device 118 through a website by using the mobile device owner computer 124. The website can require the mobile device owner to pay for a subscription to an event before permitting the mobile device owner to input the physical identifier 210 field for the mobile device 118 to be activated to receive the local broadcast of the event. Then the method proceeds to box 310.

In box 306, the scanner 116 scans the mobile device 118 for activation. For example, a mobile device activation system employee uses the scanner 116 to scan the bar code located on the exterior surface of the mobile device 118 to be activated. The mobile device activation system employee can require the mobile device owner to pay for a subscription to an event before scanning the mobile device 118 to be activated to receive the local broadcast of the event.

In box 308, the scanner 116 displays data for the scanned mobile device 118. For example, the scanner 116 displays the name 244 field to confirm that the mobile device activation system employee is identifying the mobile device 118 for activation to receive the local broadcast of the event desired by the mobile device owner.

In box 310, a database manager application checks the physical identifier 210 field for the mobile device 118 against a deactivation list of physical identifiers. For example, the database manager checks the barcode for the mobile device 118 against a deactivation list of physical identifiers, a list compiled of physical identifiers for mobile devices specified as stolen or missing by the stolen or missing 216 status in the devices 202 table. The deactivation list of physical identifiers can include a bar code that matches a bar code scanned by the mobile device activation system employee.

If the deactivation list specifies the mobile device 118 is lost or stolen, the mobile device activation system employee can notify the mobile device owner that activation of the mobile device 118 is not possible until the mobile device owner addresses the inclusion on the list of the physical identifier 210 field for the mobile device 118. Alternatively, if the deactivation list specifies the mobile device 118 is lost or stolen, the mobile device owner computer 124 can display a message to notify the mobile device owner that activation of the mobile device 118 is not possible until the mobile device owner addresses the inclusion on the list of the physical identifier 210 field for the mobile device 118.

In box 312, the database manager determines the electronic identifier 212 field corresponding to the physical identifier 210 field for the mobile device 118. If the electronic identifier 212 field for the mobile device 118 is the same as the physical identifier 210 field for the mobile device 118, determining the electronic identifier 212 field can simply require formatting the physical identifier 210 field in a form recognized as the electronic identifier 212 field. However, to prevent the mobile device owner from activating the mobile device 118 for an event without paying for the activation, the electronic identifier 212 field for the mobile device 118 can differ from the physical identifier 210 field for the mobile device 118, such that the mobile device owner does not know the electronic identifier 212 field. For example, the database manager references the scanned physical identifier 210 field in the devices 202 table for the mobile device 118 to determine the corresponding electronic identifier 212 field in the devices 202 table for the mobile device 118.

In box 314, the database manager adds the identifier for the mobile device 118 to an activation list of identifiers. For example, the database manager adds the electronic identifier 212 field for the mobile device 118 to a list of electronic identifiers for mobile devices already subscribed to an event, those already approved for activation. The database manager can also record the subscription date 224, when a mobile device owner subscribes to receive a local broadcast of an event for the mobile device 118. Additionally, the database manager can record the season subscription 226 field, whether a subscription is for an entire season of events, rather than a subscription for a single event. Furthermore, the database manager can record the subscription user identifier 228 field, the mobile device activation system user who recorded the subscription.

In box 316, an interface provides the activation list to a broadcaster, wherein the broadcaster locally broadcasts the activation list to activate mobile devices for an event. For example, the broadcast server 126 retrieves the activation list, which includes the electronic identifier 212 field for each mobile device 118, 130, and 132 subscribed to the event, from the database server 122 through the wired or wireless network 120. Then the broadcast server 126 provides the activation list to the broadcast tower 128, which broadcasts the activation list to each mobile device 118, 130, and 132. Each mobile device 118, 130, and 132 on the activation list recognizes the broadcast of the corresponding electronic identifier 212 field for the corresponding mobile device 118, 130, and 132, and activates to receive the local broadcast of the event. If a mobile device 118 is not subscribed to the event, the activation list broadcast by the broadcast tower 128 does not include the electronic identifier 212 field for the mobile device 118, and the mobile device 118 does not activate to receive the local broadcast of the event.

When the broadcast tower 128 broadcasts the activation list to each mobile device 118, 130, and 132, the broadcast server 126 provides an event code with the activation list to the broadcast tower 128. The broadcast of the event code begins based on the start date and time 246 field for the corresponding event and stops based on the end date and time 248 field for the corresponding event.

The broadcast tower 128 periodically broadcasts the event code and the activation list for multiple reasons. First, a mobile device owner can physically turn on their mobile device 118 at any time after broadcast of the activation list begins. Periodic broadcasting on the activation list insures that the mobile device 118 is activated for each mobile device owner who has subscribed to the event, regardless of when the mobile device owner turned on their mobile device 118.

Additionally, the broadcast tower 128 periodically broadcasts the event code as part of an additional check for stolen or lost mobile devices. The input continually received by the mobile device activation system includes not only identifications of mobile devices for activation, but also identifications of mobile devices for deactivation. If a mobile device owner loses the mobile device 118 or has the mobile device 118 stolen, the user can enter input to the mobile device activation system that modifies the deactivation list to specify the mobile device 118 is lost or stolen. Similar to the situation when the mobile device activation system activates the mobile device 118 that subscribed to the event following the beginning of the event, even after the event begins the mobile device activation system can remove the identification of the mobile device from the activation list to deactivate the mobile device 118 that is reported as lost or stolen.

Furthermore, associating the event code with the activation list ensures that each mobile device 118, 130, and 132 is activated to receive signals only at that event. Once activated by the broadcast of the event code for the current event and the activation list, including the electronic identifier 212 field for the mobile device 118, the mobile device 118 maintains activation as long as the mobile device 118 continues to receive broadcasts streams having the specified event code for the event. Once the mobile device 118 is no longer receiving broadcasts of the event code, because the event is over or because the mobile device owner takes the mobile device 118 out of the local broadcast range of the broadcast tower 128, the mobile device 118 deactivates. Therefore, at a subsequent event, for which the mobile device 118 is not subscribed, the mobile device 118 will not be activated because the mobile device 118 no longer receives the event code that maintained activation of the mobile device 118 for the previous event. Additionally, the mobile device 118 will not activate because the activation list broadcast by the broadcast tower 128 no longer includes the electronic identifier 212 field for the mobile device 118.

If the activation list is corrupted during an event, the broadcaster does not want the activation list corruption to result in the loss of activation for all subscribing mobile devices during the event. Therefore, in some embodiments, the broadcaster embeds the universal activation code in the broadcast stream. When the broadcast tower 128 broadcasts the universal activation code, each mobile device receiving the broadcast is activated to receive local broadcasts of the event, regardless of whether the mobile device 118 is subscribed for the event or not. Once the activation list is restored, the database manager provides the restored activation list to the broadcast server 126, and the broadcast tower 128 broadcasts the restored activation list instead of the universal activation code. Then the mobile devices subscribed to the event maintain activation, but any mobile devices not subscribed to the event deactivate due to the absence of broadcasts of the universal activation code. The universal activation code can include an activation list of the electronic identifier 212 field for each mobile device 118, 130, and 132 listed in the database. Alternatively, the universal application code can include a separate data code used only for activating all mobile devices within the local broadcast range.

In addition to activating mobile devices sold to mobile device owners, the mobile device activation system can also activate mobile devices rented to mobile device users. A rental mobile device 118 can be scanned for activation, as in box 306, or a mobile device activation system user can input an identifier for the rental mobile device 118 through a user interface, as in box 304. Alternatively, all rental mobile devices returned for inventory (by inputting identifiers through a user interface or scanning) following a previous event can be added to the activation list for a subsequent event. Because the activation list for an event does not include the electronic identifier 212 field for a rental mobile device not returned prior to the event, stolen or missing rental devices do not activate for subsequent events.

The database manager can use the data in the transactions 206 table to handle rental mobile devices that have been refurbished and sold as retail mobile devices. For example, the type 230 field specifies the type of a transaction as a sale of the mobile device 118 that previously received broadcasts as a rental mobile device 118. The description 234 field can specify additional information for the transaction beyond the type 232 field, such as the name of the individual that purchased the mobile device 118, the timestamp 238 field can specify the time and date for the sale, and the transaction user identifier 240 field can identify the mobile device activation system user who recorded the sale.

Figure 4:
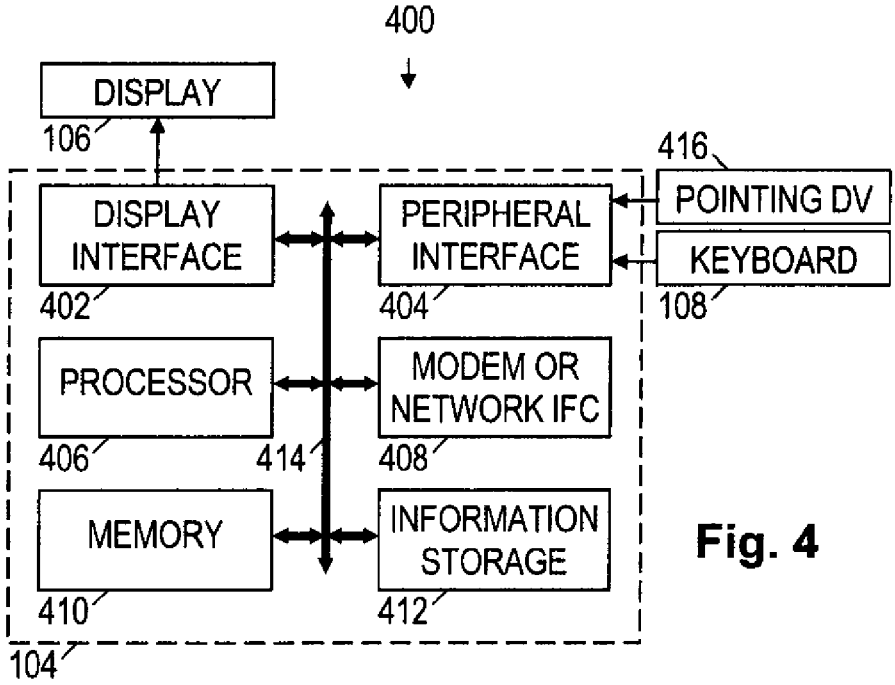
FIG. 4 shows a block diagram of an illustrative mobile device activation computer according to some embodiments of the present disclosure.

FIG. 4 shows a simplified functional block diagram 400 of the desktop computer 102 system according to some embodiments of the present disclosure. The chassis 104 may comprise a display interface 402, a peripheral interface 404, a processor 406, a modem or other suitable network interface 408, a memory 410, an information storage device 412, and a bus 414. The desktop computer 102 may be a bus-based computer, with the bus 414 interconnecting the other elements and carrying communications between them. The display interface 402 may take the form of a video card or other suitable display interface that accepts information from the bus 414 and transforms it into a form suitable for the display 106. Conversely, the peripheral interface 404 may accept signals from the keyboard 108 and other input devices such as a pointing device 416, and transform them into a form suitable for communication on the bus 414.

The processor 406 gathers information from other system elements, including input data from the peripheral interface 404, and program instructions and other data from the memory 410, the information storage device 412, or from a remote location via the network interface 408. The processor 406 carries out the program instructions and processes the data accordingly. The program instructions may further configure the processor 406 to send data to other system elements, comprising information for the user which may be communicated via the display interface 402 and the display 106, information such as data about the mobile device 118 for activation to receive a local broadcast of an event.

The network interface 408 enables the processor 406 to communicate with remote systems via a network. The memory 410 may serve as a low-latency temporary store of information for the processor 406, and the information storage device 412 may serve as a long term (but higher latency) store of information, including information such as an activation list of identifiers for mobile devices for activation to receive a local broadcast of an event.

The processor 406, and hence the desktop computer 102 as a whole, operates in accordance with one or more programs stored on the information storage device 412. The processor 406 may copy portions of the programs into the memory 410 for faster access, and may switch between programs or carry out additional programs in response to user actuation of the input device. The additional programs may be retrieved from the information storage device 412 or may be retrieved from remote locations via the network interface 408. One or more of these programs configures the desktop computer 102 system to carry out at least one of the mobile device activation methods disclosed herein.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein, but may be modified within the scope of the appended claims along with their full scope of equivalents. For example, the various elements or components may be combined or integrated in another system or certain features may be omitted, or not implemented.

What is claimed is:

1. A mobile device activation method, comprising:

scanning a mobile device for an identifier of the mobile device for activation of the mobile device to receive a local broadcast of an event;

adding the identifier for the mobile device to an activation list comprising a plurality of identifiers for mobile devices subscribed for the event;

providing the activation list to a broadcaster, wherein the broadcaster locally broadcasts the event and the activation list with the event to local mobile devices such that each of the local mobile devices receives the activation list comprising the plurality of identifiers and each of the local mobile devices that detects their identifier on the activation list activates for the event;

checking a physical identifier for the mobile device against a deactivation list of physical identifiers;

removing the identifier for the mobile device from the activation list for the event when a match of the identifier is found in the deactivation list; and providing the activation list without the identifier to the broadcaster, wherein the broadcaster locally broadcasts the activation list without the identifier to local mobile devices to deactivate the mobile device having the identifier that was removed from the activation list for the event.

2. The method of claim 1 wherein adding the identifier for the mobile device to the activation list of identifiers comprises determining an electronic identifier corresponding to a physical identifier for the mobile device.

3. The method of claim 1 wherein broadcasts of the activation list comprise an event code for maintaining activation of the mobile devices.

4. The method of claim 3 wherein the event code uniquely associates the activation list with the event.

5. The method of claim 1 further comprising providing a universal activation code to the broadcaster, wherein the broadcaster broadcasts the universal activation code to activate all local mobile devices.

6. The method of claim 1 wherein the broadcaster locally broadcasts the activation list more than once during the event.

7. The method of claim 1 wherein each of the mobile devices having their identifier on the activation list for receiving the event recognizes the broadcast of their corresponding identifier and activates to receive the local broadcast of the event.

8. A mobile device activation system, comprising:

an activation system to receive an identifier of a mobile device for activation of the mobile device to receive a local broadcast of an event;

a database manager to add the identifier for the mobile device to an activation list comprising a plurality of identifiers for mobile devices subscribed for the event, and an interface to provide the activation list to a broadcaster, wherein the broadcaster locally broadcasts the activation list in a broadcast stream of the event to local mobile devices such that each of the local mobile devices receives the activation list comprising the plurality of identifiers and each of the local mobile devices that detects their identifier on the activation list activates for the event and each of the local mobile devices that was previously activated for the event that does not detect their identifier on the activation list for the event deactivates for the event.

9. The system of claim 8 wherein the activation system comprises a scanner to receive the identifier of the mobile device for activation.

10. The system of claim 9 wherein the scanner is further operable to display data for the identified mobile device.

11. The system of claim 8 wherein the activation system comprises a user interface to receive the identifier of the mobile device for activation.

12. The system of claim 8 wherein the database manager is further operable to check a physical identifier for the mobile device against a deactivation list of physical identifiers.

13. The system of claim 8 wherein the database manager is further operable to determine an electronic identifier corresponding to a physical identifier for the mobile device.

14. The system of claim 8 wherein broadcasts of the activation list comprise an event code for maintaining activation of the mobile devices.

15. The system of claim 8 wherein the interface further provides a universal activation code to the broadcaster, wherein the broadcaster broadcasts the universal activation code to activate all local mobile devices.

16. A mobile device activation method, comprising:

obtaining a user input identifying a mobile device for activation to receive a local broadcast of an event;

adding an identifier for the mobile device corresponding to the user input to an activation list comprising a plurality of identifiers for mobile devices subscribed for the event;

providing the activation list to a broadcaster, wherein the broadcaster locally broadcasts the activation list to local mobile devices such that each of the local mobile devices receives the activation list comprising the plurality of identifiers and each of the local mobile devices that detects their identifier in the activation list activates for the event; and providing a universal activation code to the broadcaster if there is a problem with the activation list, wherein the broadcaster locally broadcasts the universal activation code such that each of the local mobile devices that receives the universal activation code activates for the event.

17. The method of claim 16 wherein adding the identifier for the mobile device to the activation list of identifiers comprises checking the user input identifying the mobile device against a deactivation list of physical identifiers.

18. The method of claim 16 wherein adding the identifier for the mobile device to the activation list of identifiers comprises determining an electronic identifier corresponding to the user input identifying the mobile device.

19. The method of claim 16 wherein broadcasts of the activation list comprise an event code for maintaining activation of the mobile devices.

* * * * *